US005404080A

United States Patent [19]

Quazi

[11] Patent Number: 5,404,080

[45] Date of Patent: Apr. 4, 1995

[54] LAMP BRIGHTNESS CONTROL CIRCUIT WITH AMBIENT LIGHT COMPENSATION

[75] Inventor: Fazle Quazi, Boulder, Colo.

[73] Assignee: Etta Industries, Inc., Boulder, Colo.

[21] Appl. No.: 270,312

[22] Filed: Jul. 5, 1994

Related U.S. Application Data

[63] Continuation of Ser. No. 789,268, Nov. 8, 1991, abandoned, which is a continuation-in-part of Ser. No. 410,480, Sep. 21, 1989, Pat. No. 5,245,253.

[51] Int. Cl.[6] ..... H05B 37/00

[52] U.S. Cl. ..... 315/151; 315/156; 315/158

[58] Field of Search ..... 315/151, 158, 156, 150, 315/152, 154, 155, 157, 159

[56] References Cited

U.S. PATENT DOCUMENTS

| | | | |
|---|---|---|---|
| 3,681,654 | 8/1972 | Quinn | 315/151 |
| 3,996,494 | 12/1976 | Suga | 315/151 |
| 4,164,686 | 8/1979 | Vital et al. | 315/151 |
| 4,234,820 | 11/1980 | Widmayer | 315/151 |
| 4,371,812 | 2/1983 | Widmayer | 315/291 |
| 4,394,603 | 7/1983 | Widmayer | 315/311 |
| 4,464,606 | 8/1984 | Kane | 315/158 |
| 4,482,844 | 11/1984 | Schweer et al. | 315/194 |
| 4,701,669 | 10/1987 | Head et al. | 315/156 |
| 4,933,605 | 6/1990 | Quazi et al. | 315/224 |
| 4,982,139 | 1/1991 | Amir et al. | 315/158 |

*Primary Examiner*—Robert J. Pascal
*Assistant Examiner*—Tan Dinh
*Attorney, Agent, or Firm*—Sixbey, Friedman, Leedom & Ferguson

[57] ABSTRACT

A compact auxiliary circuit modifies the operation of a low-voltage control circuit associated with an electronic dimming gas discharge lamp ballast. The auxiliary circuit modifies the output of the control circuit to reduce the brightness of the lamps when excess ambient light is available, and increases the brightness of the lamps as available ambient light is reduced. The auxiliary circuit is located in a small housing which mounts in a knockout plug of a fluorescent ceiling fixture. In a preferred embodiment, the auxiliary circuit includes a photocell that obtains information on ambient light levels through an ambient light gathering prism mounted through a ceiling tile near the fixture, and connected to the circuit housing by a flexible fiber optic cable. A single auxiliary circuit according to the invention can be connected to vary the brightness of a large number of lamps.

25 Claims, 5 Drawing Sheets

LAMP BRIGHTNESS CONTROL CIRCUIT WITH AMBIENT LIGHT COMPENSATION

This application is a continuation of Ser. No. 07/789,268, filed Nov. 8, 1991, now abandoned which is a continuation in part of Ser. No. 07/410,480, filed Sep. 21, 1989, and now U.S. Pat. No. 5,245,253.

FIELD OF THE INVENTION

The present invention relates broadly to a circuit for controlling the brightness of a lamp to maintain a desired ambient light level in an area, despite variations in the amount of light supplied by a source external to the circuit.

BACKGROUND OF THE INVENTION

In recent years, the fluorescent lamp, which requires less energy than the incandescent lamp to produce the same amount of light, has enjoyed increasing popularity. In many modern offices, fluorescent lamps are used to the complete exclusion of incandescent lamps. Other gas discharge lamps, such as sodium-vapor lamps, have replaced incandescent lamps in outdoor lighting applications.

To maintain high energy efficiency, reliable operation, and long lamp life, these gas discharge lamps may be operated in conjunction with a resonant inverter ballast circuit, such as the ballast shown in the inventor's U.S. Pat. No. 4,933,605.

Electronic dimming control circuits, such as the circuit disclosed in the inventor's copending U.S. patent application Ser. No. 07/410,480 filed Sep. 21, 1989, have been used with resonant inverter ballasts to provide effective low-voltage control of gas discharge lamp brightness. In the preferred embodiment of the dimming circuit disclosed in the Ser. No. 07/410,480 application, the dimming level is controlled by a low voltage input level produced by integrating a variable pulse width output from an electronic dimming control circuit.

Such electronic dimming circuits are generally provided with an operator-adjusted manual control for setting the desired level of gas discharge lamp luminosity. It is also known to turn lamps on and off in response to photocell measurement of ambient light levels. In a common application of this technique, a photocell may be used to turn on a parking lot lamp during periods of darkness (i.e. night) and to turn the lamp off during periods when sufficient external light sources (such as sunlight) are available, thus conserving energy.

In an office setting, each work area must at all times be provided with at least a minimum level of light. The minimum necessary light level is determined based on the tasks performed in the area. Fluorescent lamps are generally installed in size and number sufficient to provide the minimum required light level in an area under the assumption that no other light sources will be available. A dimming circuit may be provided to adjust the light output of the lamps, permitting multiple uses of the area and compensation for changes in external light.

At times, other light sources are also operating in the area so that the amount of light produced is more than is needed, and the operation of the lamps at the same intensity used in the absence of other light sources is a waste of energy. For example, during the day sunlight may enter through windows and skylights. When these other light sources are available, the preset brightness of the gas discharge lamps will not be needed in its entirety since the external light source provides some or all of the minimum needed light in the area. It would be possible to conserve large quantities of energy, possibly up to 30% of the energy used to light a typical office building, if the light output of gas discharge lamps could be limited at all times to the minimum required level.

Additionally, in the workplace, it is usually desirable to have a constant level of light on work surfaces. Continually changing light levels result in periods of glare when too much light is provided and period of increased difficulty in resolving images when too little light is provided. A worker's eyes must adjust to resolve images at a given light level. Thus, continual light level variations requires continuous optic compensation, and this eyestrain over time can adversely affect health and productivity.

U.S. Pat. Nos. 4,482,844 to Schweer et al., and 4,371,812 and 4,394,603 to Widmayer, show systems for dimming a fluorescent lamp in response to ambient light conditions. U.S. Pat. No. 4,464,606 to Kane discloses a fluorescent lamp dimmer with an electronic inverter that is controlled in response to signals from a ceiling-mounted ambient light sensor. The dimming control circuit shown operates using low voltages and pulse width modulation of the power to the lamps, but does not integrate pulse-width modulated control signals to produce the dimming control signal that controls the width of the lamp switching control pulses. As far as the inventor is aware, electronic dimming control circuits of the type disclosed in the aforementioned pending application have not been equipped with circuits for adjusting the lamp output to minimize energy consumption while maintaining a constant light level in an area.

SUMMARY OF THE INVENTION

Therefore, it is a general object of the present invention to provide an energy saving control circuit for gas discharge lamps.

Another broad object of the present invention to provide a circuit which maintains a constant desired light level in an area.

A further object of the present invention is to provide a control circuit for one or more gas discharge lamps which maintains a constant light level in an area by measuring the ambient light and reducing the output of the lamps by the amount of light contributed by external light sources.

Another important object of the present invention is to provide a low voltage ambient light monitoring circuit having low power requirements which can be used to control a plurality of electronic ballasts to dim ballasted lamps in response to the ambient light level.

Other objects of the invention will become apparent upon review of the specification, drawings, and claims.

These objects and others are achieved by providing a compact, easily installed auxiliary circuit which operates with a low-voltage control circuit associated with an electronic dimming lamp ballast. The auxiliary circuit modifies the output of the control circuit to reduce the brightness of the lamps when excess ambient light is available, and increases the brightness of the lamps as available ambient light is reduced. The auxiliary circuit is located in a small housing which mounts in a knock-out plug of a fluorescent ceiling fixture. The auxiliary circuit includes a photocell that obtains information on ambient light levels through an ambient light gathering prism mounted in the ceiling near the fixture, and connected to the circuit housing by a flexible fiber optic cable. A single circuit according to the invention can be used to control multiple ballasts.

BRIEF DESCRIPTION OF THE DRAWINGS

FIG. 6*a* is a frontal view of the light-gathering prism of the present invention, while

DETAILED DESCRIPTION OF THE PREFERRED EMBODIMENTS

The lamp ballast and dimming circuit with which the present invention may be used will first be described with reference to FIGS. 1 and 2.

Figure 1:
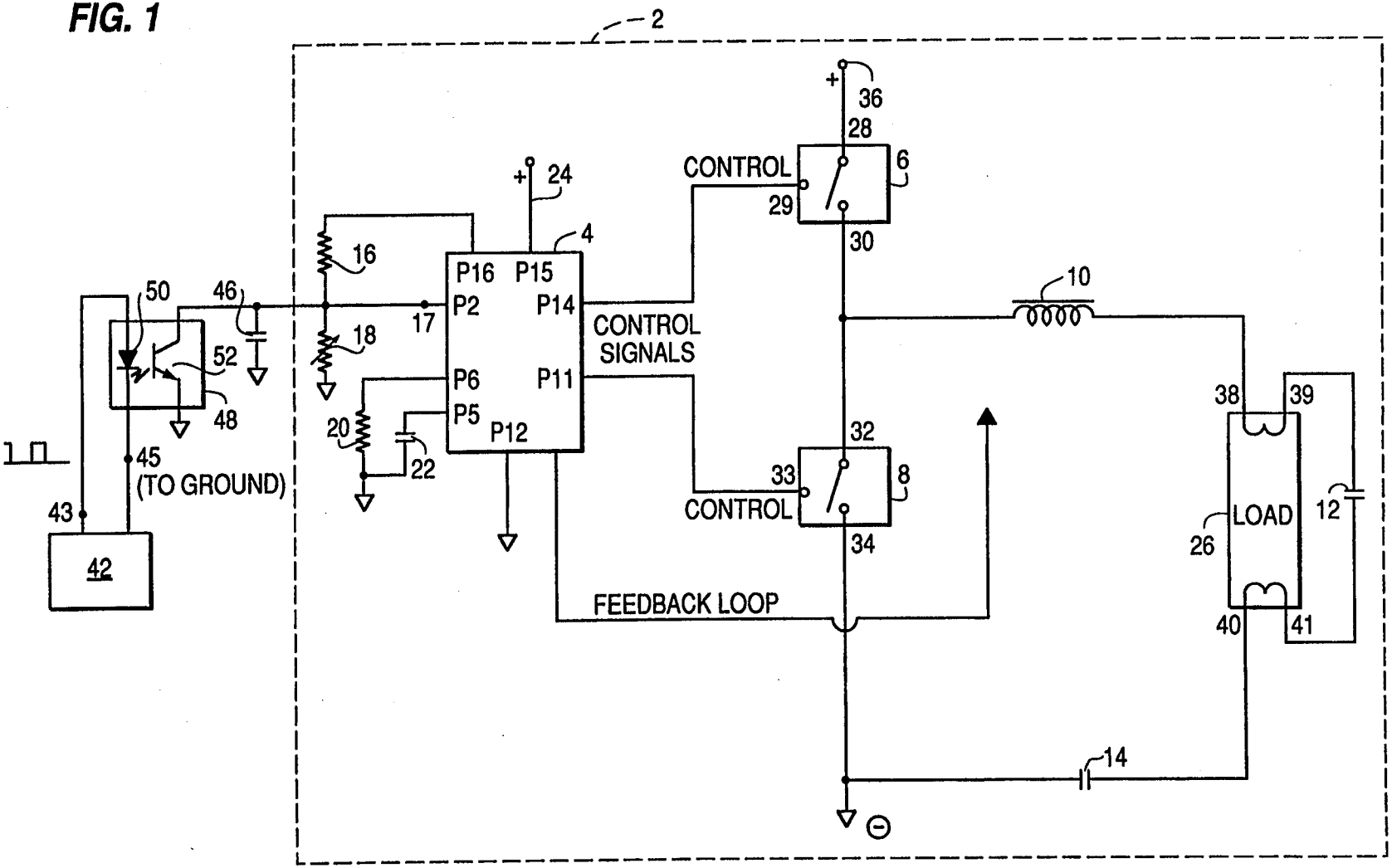
FIG. 1 is a circuit diagram of a solid-state electronic ballast circuit showing a pulse-width modulation dimming control circuit connected to control the ballast.

Referring first to FIG. 1, a resonant inverter solid-state dimming ballast circuit is shown generally at 2. While a brief description of the construction and operation of this circuit will be provided here, the solid-state dimming ballast 2 is described completely in the inventor's U.S. Pat. Nos. 4,993,605 and 4,864,482, the disclosures of which are incorporated herein by reference.

As shown in FIG. 1, the solid-state dimming ballast 2 comprises pulse width modulator 4, power switches 6 and 8, resonant inductor 10, resonant capacitor 12, blocking capacitor 14, voltage divider resistor 16, variable resistor 18, oscillator resistor 20, oscillator capacitor 22, and load 26. Load 26 is provided with four terminals 38, 39, 40 and 41. The load 26 may preferably be a fluorescent tube and will frequently be described as such herein.

The pulse width modulator 4 may be a conventional integrated circuit such as a Motorola SG-2525, used with the following terminal connections: Vcc (pin 15) is connected to a DC voltage source 24, while the Ground terminal (pin 12) is connected to ground. The RT terminal (pin 6) is connected through oscillator resistor 20 to ground, and the CT terminal (pin 5) is connected through the oscillator capacitor 22 to ground. Vref (pin 16) is connected to one terminal of voltage divider resistor 16. The other terminal of voltage divider resistor 16 is connected to the Noninverting Input 17 (pin 2) of pulse width modulator 4 and also connected to ground through variable resistor 18. Output A (pin 11) and Output B (pin 14) of pulse width modulator 4 are connected respectively to control terminals 33 and 29 of power switches 8 and 6 respectively. For reasons which will become clear upon description of further circuits useful with the circuit of FIG. 1, the two terminals of variable resistor 18 are preferably connected to terminals accessible from the outside of any housing enclosing ballast 2 so that external circuits can be connected to these terminals.

The power switches 6 and 8 may be of any suitable solid-state or mechanical construction. Power switch 6 is provided with two switching terminals 28 and 30, and power switch 8 likewise has two switching terminals 32 and 34. Each of the power switches 6 and 8 are also provided with a control terminal 29 and 33 as described previously. In response to a signal pulse on the control terminal 29 produced by the pulse width modulator 4, the power switch 6 will internally connect power terminals 28 and 30 so that devices connected to power terminal 28 will be electrically connected with devices connected to power terminal 30. The power switch 8 likewise connects power terminals 32 and 34 in response to a signal pulse from the pulse width modulator 4 transmitted to the control terminal 33 of power switch 8.

A positive DC source 36 is connected to power terminal 28 of power switch 6, and power terminal 30 is connected both to the power terminal 32 of power switch 8 and to one terminal of resonant inductor 10. The other terminal of resonant inductor 10 is connected to terminal 38 of load 26. Power terminal 34 of power switch 8 is connected both to ground and to one terminal of the blocking capacitor 14. The other terminal of blocking capacitor 14 is connected to terminal 40 of fluorescent tube (load) 26, the terminal 40 being at the opposite end of the tube from terminal 38. The resonant capacitor 12 is connected across terminals 39 and 41 of the fluorescent tube 26.

Oscillator resistor 20 and oscillator capacitor 22 together control the frequency of the internal oscillator of pulse width modulator 4, which in turn controls the frequency of the output pulses from Outputs A and B (pins 11 and 14) of the pulse width modulator 4, which in turn control the switching of power to the fluorescent tube 26 as will be explained later in more detail. Thus, the values of oscillator resistor 20 and oscillator capacitor 22 are chosen to provide the desired frequency of power switching at fluorescent tube 26.

The power switches 6 and 8 are alternately actuated by the signals at control terminals 29 and 33 respectively. In operation, power switch 6 is actuated first, so that DC current flows from DC source 36 through resonant inductor 10, load 26, and resonant capacitor 12, charging blocking capacitor 14. Power switch 6 is then deactuated. After a brief period of time, power switch 8 is actuated, so that stored charge flows from blocking capacitor 14 through load 26, resonant capacitor 12, and resonant inductor 10 to ground, thus discharging blocking capacitor 14. After a brief time delay this cycle is repeated, with the repetition at a constant frequency determined by the values of oscillator resistor 20 and oscillator capacitor 22 as explained previously. The repetition of this switching operation produces an alternating current flow through load 26. When the load 26 is a fluorescent tube, this current flow will excite the internal gases of the tube, causing the tube to glow.

The amount of time between repetitions of the cycle just explained is determined by the duty cycle of the control pulses produced by pulse width modulator 4 and transmitted to control terminals 29 and 33. As the duty cycle of the control pulses increases, the duty cycle of power applied to the load 26 will increase, increasing the apparent brightness of the fluorescent tube 26. Conversely, as the duty cycle of the control pulses decreases, the apparent brightness of the fluorescent tube 26 will decrease. Thus, the circuit can be used to produce a dimming function.

The duty cycle of the control pulses produced by pulse width modulator 4 is varied by varying the voltage applied to the non-inverting input 17 of pulse width modulator 4.

The dimming control circuit used in the dimming ballast circuit of FIGS. 1 and 2, comprising pulse generating circuit 42, will now be described in detail.

As shown in FIG. 1, pulse generating circuit 42 is connected as a control input to the resonant inverter solid-state ballast 2. The output 43 of dimming control circuit 42 is connected to opto-isolator 48. If no isolation is desired, output 43 could also be directly connected to the base of an ordinary transistor substituted for phototransistor 52 and having the same emitter and collector connections as phototransistor 52.

Opto-isolator 48 comprises a light-emitting diode (LED) 50 and a phototransistor 52. LED 50 is connected between output 43 and ground. Phototransistor 52 has its collector connected to non-inverting input 17 and its emitter connected to ground. Phototransistor 52 turns on in response to light emissions from LED 50, which operates in response to the pulses from output 43. Opto-isolator 48 thus electrically isolates the ballast 2 from the pulse generating circuit 42. The ballast circuitry may contain large voltages and current, and as will be seen, controls for the pulse generating circuit 42 will be handled by human operators. Therefore, this electrical isolation provides a substantial safety benefit.

The collector of phototransistor 52 is connected to non-inverting input 17 of pulse width modulator 4, while the emitter of phototransistor 52 is connected to ground. An integrating capacitor 46 is connected between the non-inverting input 17 and ground. The pulse generating circuit 42 preferably generates a variable duty cycle, square wave pulse train at a fixed frequency greater than 1 kHz.

The output pulses at output 43 control the charging of integrating capacitor 46. When pulse generating circuit 42 produces a pulse at output 43, the voltage applied to the base of transistor 44 turns on phototransistor 52, allowing current to flow from the collector to the emitter of the transistor 44. Because the collector of phototransistor 52 is connected to the capacitor 46 and the non-inverting input 17, and since the emitter of phototransistor 52 is connected to ground, a pulse from pulse generating circuit 42 effectively grounds the integrating capacitor 46, tending to discharge the capacitor 46. When output 43 is not producing a pulse, phototransistor 52 is turned off, and integrating capacitor 46 tends to charge to the level of the voltage drop across variable resistor 18 as determined by the voltage divider comprising resistor 16 and variable resistor 18.

The voltage at non-inverting input 17 varies with the duty cycle of the pulses at output 43. Since the output 43 produces a series of pulses at high frequency, the pulses produce a periodic pull up and down of the DC level across integrating capacitor 46. Integrating capacitor 46 integrates over time the DC level shift produced by the pulsed output 43, so that for a given pulse duty cycle, a continuous DC voltage appears at non-inverting input 17. The DC voltage at non-inverting input 17 will vary with the duty cycle of the pulsed output 43 in the following manner. As the duty cycle increases, the capacitor 46 will be grounded for a relatively greater portion of time, and the voltage at non-inverting input 17 will be reduced. Conversely, as the duty cycle of pulses at output 43 is reduced, the voltage at non-inverting input 17 will be increased.

Because the voltage level at non-inverting input 17 controls the apparent brightness of load 26, those skilled in the art will immediately appreciate that the light output of load 26 can be adjusted by varying the duty cycle of the pulses at output 43. Thus, the dimming of the solid-state ballast is controlled by varying the duty cycle of a low-voltage pulsed input to the control circuitry of the ballast.

The circuit and operation of the pulse generating circuit 42 will now be described in detail with reference to FIG. 2. As shown in FIG. 2, the pulse generating circuit 42 comprises a power supply section 54, a reset section 56, a delay section 58, an overcurrent section 60, a pulse control section 62, a brightness control section 64, and a variable duty cycle frequency source 65.

The variable duty cycle frequency source 65 may preferably be an UC2843 integrated circuit manufactured by Motorola, although other integrated circuits could be used, or a circuit could be constructed to perform the necessary functions. The operation of the frequency source 65 is described in detail in Motorola publications which will be familiar and accessible to those skilled in the art. However, the functions of the pins used in this circuit are described in Table 1 in sufficient detail to permit those skilled in the art to understand the circuit and to practice the invention disclosed.

TABLE 1

Pin Connections of UC2843 Frequency Source

| PIN | NAME | DESCRIPTION |
|---|---|---|
| 1 | Compensation | Voltage may be applied externally to vary the duty cycle of the pulses. |
| 2 | Inv. Input | Not Used (connected to ground). |
| 3 | Current Sense | Inhibits pulse output if more than one volt is applied externally. |
| 4 | OSC | Provides sawtooth wave output with frequency depending on external circuitry. |
| 5 | Ground | Connected to ground. |
| 6 | Output | Produces variable duty cycle pulse output with frequency depending on external circuitry connected to OSC terminal and duty cycle depending on voltage applied to Compensation terminal. |
| 7 | Vcc | Power supply (+12 v DC). |
| 8 | Vref | Reference voltage output (5.1 VDC). |

Referring again to FIG. 2, the power supply section 54 comprises a transformer 66, a full-wave bridge rectifier 68, a capacitor isolation diode 70, and a smoothing capacitor 72. The power supply section is preferably also provided with a conventional three-terminal, 12 volt voltage regulator 84 and an associated capacitor 86. The voltage regulator 84 has an input terminal 88, an output terminal 90, and a ground terminal 92.

Alternating current input from an AC source 74 is connected to the primary coil of transformer 66. The turns ratio of transformer 66 is selected with reference to the voltage of AC source 74 so that 12 volts AC is produced on the secondary coil. Full-wave bridge rectifier 68 is a conventional device. The rectifier 68 has two input terminals 75 and 78 and two output terminals 80 and 82. The two terminals of the secondary coil of transformer 66 are connected respectively to input terminals 75 and 78 of rectifier 68. Output terminal 80 of rectifier 68 is connected to circuit and Earth ground, while output terminal 82 is connected to the anode of isolation diode 70 and provides a rectified, 12 volt DC output thereto. The cathode of diode 70 is connected to the input terminal 88 of regulator 84 and to the positive terminal of smoothing capacitor 72. The negative terminal of smoothing capacitor 72 is connected to both circuit ground and Earth ground.

The output terminal 90 of regulator 84 is connected to Vcc (pin 7) of variable duty cycle frequency source 65, and ground terminal 92 is connected to ground. The capacitor 86 is connected between the output terminal 92 of regulator 84 and ground. The voltage regulator 84 compensates for variations in the voltage of AC source 74, thus stabilizing the 12 volt DC power provided to the integrated circuits of frequency source 65. A stable voltage supply for frequency source 65 is necessary to avoid variations in the pulse signal output 43 of the frequency source 65.

Preferably, the 12 volt DC regulated output at output terminal 90 of regulator 84 will be used as the DC source 24 connected to Vcc of the pulse width modulator 4 (shown in FIG. 1). In this way, the entire circuit may be controlled by a single power switch (not shown in the drawings). This switch may be any conventional switch and may be installed in the power supply circuitry in a number of ways which are conventional and will be immediately apparent to those skilled in the art.

The brightness control section 64 comprises a variable resistor 94 and a voltage divider resistor 96. The variable resistor 94 is connected between the compensation pin (pin 1) of frequency source 65 and ground. Preferably, for reasons which will become more obvious, the two terminals of variable resistor 94 will be connected to terminals on the outside of a housing containing electronic dimming circuit 42 and/or ballast 2 so that wires from external devices can be connected to the terminals of variable resistor 94. Voltage divider resistor 96 is connected between Vref (pin 8) of frequency source 65 and the compensation pin (pin 1) of frequency source 65. Vref (pin 8) of frequency source 65 provides a constant 5.1 volt DC signal. Thus, the variable resistor 94 and resistor 96 form a voltage divider so that, as the variable resistor 94 is adjusted, the voltage applied to the compensation pin (pin 1) of frequency source 65 will vary. As explained in Table 1, the voltage on the compensation pin (pin 1) of frequency source 65 controls the duty cycle of the pulses produced at output 43, with the duty cycle determining the brightness of the load 26 as described previously.

The power supply switch previously described may be integrated with the variable resistor 94 in a manner well known in the art.

The delay section 58 comprises a PNP transistor 98, a resistor 100, capacitor 102, and resistor 104. The emitter of transistor 98 is connected to the compensation terminal (pin 1) of frequency source 65, while the collector of transistor 98 is connected to ground. The base of transistor 98 is connected to one terminal of resistor 104, and the other terminal of the resistor 104 is connected to the output terminal 82 of bridge rectifier 68. The positive terminal of capacitor 102 is connected to the base of transistor 98, while the negative terminal of capacitor 102 is connected to ground. Resistor 100 is connected between the base of transistor 98 and ground.

As will be seen, the delay section 58 provides advantageous operation because, in operation, the delay section 58 suppresses transmission of the dimming signal at output 43 at power-up. With the dimming signal suppressed by delay section 58, the tube 26 (shown in FIG. 2) is started at full brightness. Full-brightness starting is essential for two reasons: First, full-brightness starting prolongs the life of the fluorescent tubes. Second, fluorescent tubes may not start at all if power is not provided for the full duty cycle.

The operation of delay section 58 to suppress the dimming signal at output 43 will now be described in detail. When no power is applied to the circuit 42 from AC source 74, the transistor 98 will conduct fully, thus effectively grounding the compensation terminal (pin 1) of frequency source 65. When the compensation terminal is grounded in this manner, a zero duty cycle at output 43 is selected. As explained previously, the brightness of the load 26 (shown in FIG. 2) varies inversely with the duty cycle of the pulsed output 43. A zero duty cycle of the pulsed output 43 corresponds to full brightness at the load 26 (shown in FIG. 2). Therefore, when the transistor 98 is fully conductive, the load 26 will be at maximum brightness.

When power is applied to the circuit 42, the capacitor 102 will charge according to a time constant determined by the values of resistors 100 and 104 and capacitor 102. As the capacitor 102 charges, the transistor 98 will be rendered less conductive, until the transistor 98 ceases to conduct. When the transistor 98 ceases to conduct, the delay section 58 will have no effect on the voltage at the compensation pin (pin 1) of frequency source 65. The voltage at the compensation pin (pin 1) will then be controlled entirely by the brightness control section 64.

Thus, when power is applied to the circuit 42 and the resonant inverter solid-state ballast 2 (shown in FIG. 1), the delay section 58 will initially inhibit any dimming of the load 26 (as shown in FIG. 1), regardless of the setting of variable resistor 94 (the brightness control). The load 26 will "start" at full brightness. After a brief period of time, the delay section 58 will cease to inhibit dimming and the load 26 will dim to the level selected by means of variable resistor 94. The fluorescent lamp 26 does not come on at full brightness and then suddenly become dim; the steadily increasing voltage across capacitor 102 as it charges reduces the conductance of transistor 98 steadily over a brief period of time. The voltage at the compensation pin (pin 1) of frequency source 65 will therefore increase steadily from zero to the level determined by the setting of variable resistor 94. As a result, the fluorescent lamp 26 will come on at full brightness, and then dim to the preset level in a smooth and pleasing manner.

The length of the delay produced by delay section 58 can be adjusted by changing the value of resistors 100 and 104 and capacitor 102 in accordance with well-known time constant principles.

During a power failure, fluorescent lamp 26 will be extinguished. If the power failure is brief, the capacitor 102 may retain its charge, so that delay section 58 will not provide the desired full-brightness startup and transition to the set dimming level as described. As explained previously, the lamp 26 may not start at a low-brightness setting, and even if the lamp 26 does start, its life will be shortened by a low-intensity startup. Reset section 56 operates to reset the delay section 58 during a power failure, preparing delay section 58 to operate properly when power is returned to the circuit.

Reset section 56 comprises a diode 106, resistor 108, PNP transistor 110, filter capacitor 112, and voltage divider resistors 114 and 116. The anode of diode 106 is connected to the base of delay section transistor 98, and the cathode of diode 106 is connected to one terminal of resistor 108. The other terminal of resistor 108 is connected to the emitter of transistor 110. Resistor 108 preferably has a small value, in the range of 5–7 Ohms. The collector of transistor 110 is connected to ground. The positive terminal of filter capacitor 112 is connected to the base of transistor 110, while the negative terminal of the capacitor 112 is connected to ground. One terminal of resistor 114 is connected to the output terminal 82 of full-wave bridge rectifier 68, while the other terminal of the resistor 114 is connected to the base of transistor 110. Resistor 116 is connected between the base of transistor 110 and ground.

Resistors 114 and 116 together form a voltage divider which determines the voltage at the base of transistor 110. The values of resistors 114 and 116 are chosen with reference to the values of resistors 100 and 104 so that transistor 110 does not conduct while AC power source 74 is providing power to the circuit 42. The value of capacitor 112 is chosen with reference to the values of resistors 114 and 116 so that, if power is removed from the circuit, capacitor 112 will discharge through resistor 116 in about 1 millisecond.

If a failure of power from AC source 74 occurs, the reset section 56 operates as follows: The voltage at the base of transistor 110 falls to zero within one millisecond as the capacitor 112 discharges through resistor 116. Because delay section capacitor 102 is still charged, the voltage at the emitter of transistor 110 is considerably greater than zero. Therefore, transistor 110 begins to conduct, effectively shorting and discharging the delay section capacitor 102. Thus, the reset section 56 quickly prepares the delay section 58 so that the fluorescent tube 26 may be restarted automatically at full brightness as described previously.

It should be noted that diode 70 is provided in the power supply section 54 to isolate the reset section 56 from filter capacitor 72 so that, during a power interruption, filter capacitor 72 will not discharge through the reset section 56 and prevent proper operation of the reset section 56.

The pulse control section 62 determines the frequency of the pulsed output 43 and limits the maximum duty cycle of the output pulses. Pulse control section 62 comprises NPN transistor 118, frequency set capacitor 120, frequency set resistor 122, resistor 124, variable resistor 126, and resistor 128. The base of transistor 118 is connected to the oscillator terminal (pin 4) of frequency source 65. The collector of transistor 118 is connected to Vref (pin 8) of frequency source 65, and the emitter of transistor 118 is connected to one of the two terminals of resistor 124. The other terminal of resistor 124 is connected to one of the two terminals of variable resistor 126. The other terminal voltage applied to the current sense terminal (pin 3) will be approximately 1.4 volts.

The frequency source 65 will inhibit generation of a pulse signal at output 43 whenever the voltage applied to the current sense terminal (pin 3) is greater than about one volt. Therefore, the effect of applying a high frequency ramp signal to the current sense terminal (pin 3) is to suppress pulse generation during a portion of each ramp cycle.

The ramp signal applied to the current sense terminal (pin 3) has a peak voltage Vmax. As explained previously, due to the action of the voltage divider comprising resistors 124, 126, and 128, Vmax is a fraction of the peak voltage of the ramp signal at the oscillator terminal (pin 4) of frequency source 65. Again, Vmax is preferably about 1.4 volts. A single ramp cycle takes place over a time period encompassing a first time period and a second time period. In the first time period, the voltage of the ramp signal rises from 0.6 volts to one volt; during this period, the frequency source 65 is not inhibited from transmitting a pulse at output 43. Of course, whether or not a pulse is transmitted by frequency source 65, and the actual duration of any pulse transmitted, are determined by brightness control section 64, delay section 58, and reset section 56 in the manner explained previously. During the second time period, the voltage of the ramp signal applied to the current sense terminal (pin 3) exceeds one volt, and the frequency source 65 is inhibited from producing any signal at output 43. Thus, the application of the ramp signal to the current sense terminal (pin 3) limits the maximum duty cycle of the pulses at the output 43. In the preferred embodiment described, with Vmax=1.4 volts and with the output 43 inhibited when voltages greater than 1.0 volts are applied to the current sense terminal (pin 3) of frequency source 65, the maximum duty cycle of pulses at output 43 is 50%.

Limiting the pulsed output 43 to a 50% duty cycle places an upper limit on the amount of dimming of the load 26. This limitation is desirable because dimming the load 26 excessively may shorten lamp life and will in some cases result in an unpleasant flickering effect when the load 26 is a fluorescent tube. The maximum duty cycle of the pulsed output 43 can be adjusted using variable resistor 126, and may be set at a value other than 50% as dictated by the requirements of the consumer or the design parameters of the ballast 2.

Overcurrent section 60 is a protective circuit that disables pulsed output 43 if excessive current is drawn from output 43. Overcurrent section 60 comprises a resistor 134 and a diode 136. The anode of diode 136 is connected to an output reference 45 which may serve as the ground reference for the signal at output 43. The cathode of diode 136 is connected to the current sense terminal (pin 3) of frequency source 65. Resistor 134 is connected between the anode of diode 136 and ground. Diode 136 prevents transmission of the ramp signal at the current sense terminal (pin 3) to the output reference 45.

The output 43 of frequency source 65 is inhibited when more than one volt is applied to the current sense terminal (pin 3). The voltage drop across diode 136 is approximately 0.6 volts; therefore, output 43 will be inhibited if the voltage at the anode of diode 136 is greater than 1.6 volts. This condition will occur when the voltage drop across resistor 134 is greater than 1.6 volts. Preferably, resistor 134 may be a 4.7 Ohm resistor, so that when more than 0.34 Amperes of current is drawn from output 43, the voltage drop across resistor 134 will be greater than 1.6 volts and the output 43 will be disabled. Thus, the overcurrent section 60 prevents damage to the circuit of the present invention.

Of course, each ballast 2 connected to pulse generating circuit 42 will draw current, so that there is a practical limit to the number of ballasts 2 that can be controlled by a single pulse generating circuit 42. The pulse generating circuit as disclosed will drive approximately 16 ballasts without exceeding 0.34 Amp current draw from output 43. However, if it is desired to control more than 16 ballasts 2 using one pulse generating circuit 42, an NPN power transistor can be used to increase the fanout capability of the circuit 42. The base of the power transistor may be connected to the output 43, while the collector of the power transistor is connected to a DC power source such as that provided at Vcc (pin 7) of frequency source 65. The pulse signal output to the ballasts 2 is then taken at the emitter of the power transistor. Numerous techniques of increasing fanout capacity of an output are known in the art, and will not be described further here. Thus, it can be seen that the fanout capability of the circuit 42 can be expanded to allow control of almost any number of ballasts 2 using well-known techniques.

Figure 2:
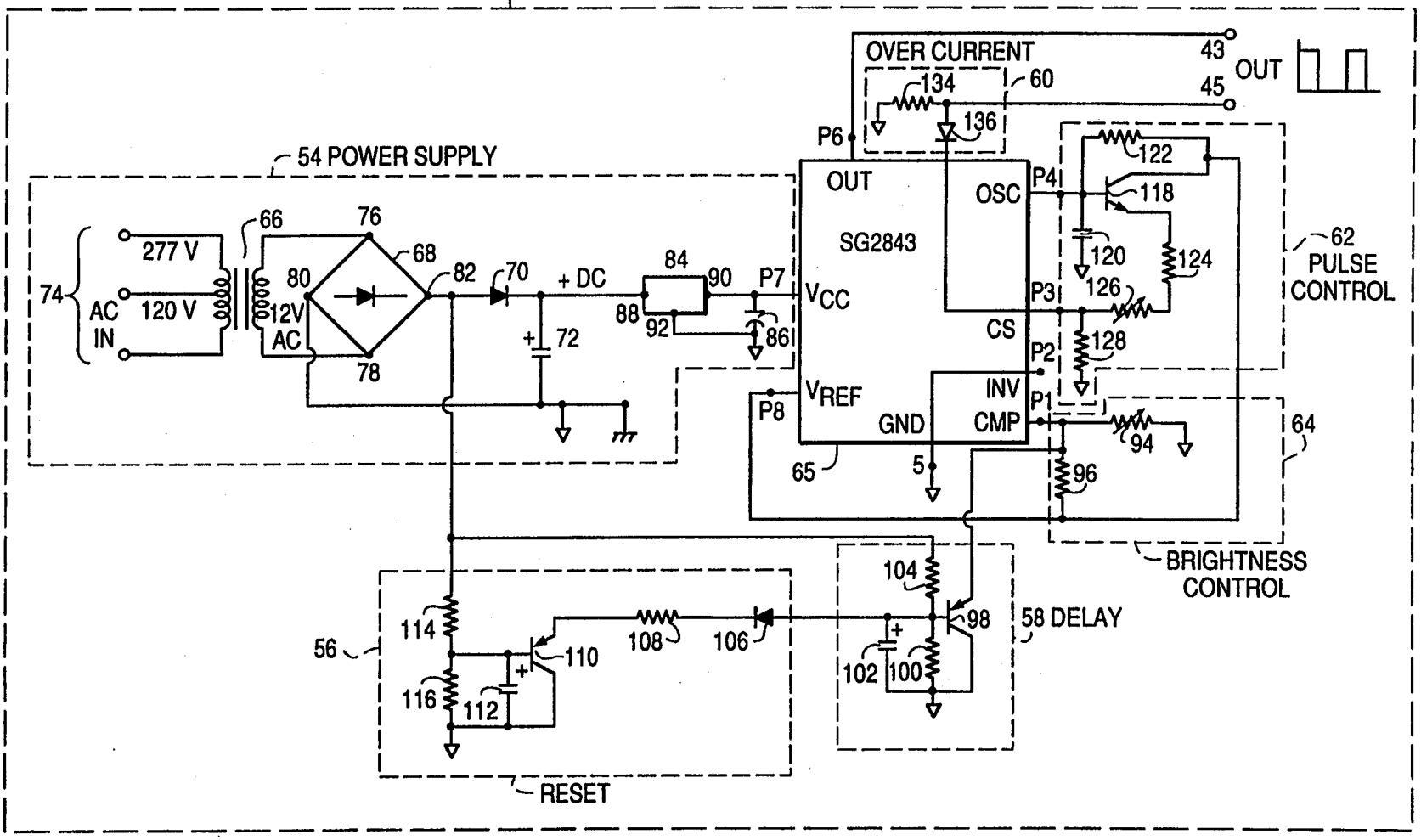
FIG. 2 is a detailed circuit diagram of the pulse-width modulation dimming control circuit shown in FIG. 1.
Figure 3:
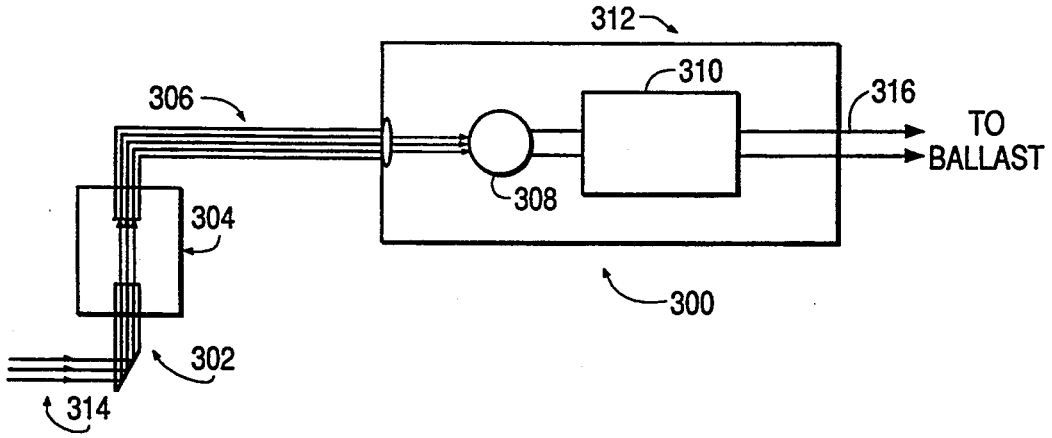
FIG. 3 is a block-schematic diagram of the ambient-light responsive control circuit of the present invention.

According to the present invention, the circuits shown in FIGS. 1 and 2 may also incorporate an ambient light responsive sensing and control circuit 300, shown in block diagram form in FIG. 3. Sensing and control circuit 300 is a means for varying the brightness of load 26 in inverse proportion to the amount of ambient light available from other sources, such as daylight. As shown in FIG. 3, sensing and control circuit 300 comprises light converging prism 302, attachment housing 304, fiber optic cable 306, photocell 308, and processing circuit 310. Photocell 308 and processing circuit 310 are contained in housing 312.

The converging prism 302 is connected to an end of fiber optic cable 306 and is arranged to gather ambient light 314 and direct the light 314 into one end of fiber optic cable 306. Fiber optic cable 306 carries the ambient light 314 from the end connected to converging prism 302 to its other end, which is connected to housing 312 with this other end in close proximity to photocell 308. The light 314 passing through fiber optic cable 306 impinges on photocell 308 so that the output of photocell 308 varies in response to the amount of light 314 gathered by prism 302, which varies with the amount of ambient light available. Photocell 308 may be a photoresistor which varies its resistance in response to the amount of light impinging upon it, so that its "output" is a pair of terminals providing a varying resistance to a receiving circuit. For example, photocell 308 may be a photoresistor such as part number CL7P5HL made by Clairex Electronics Co. of Mount Vernon, N.Y. Thus, photocell 308 produces an output varying with the amount of ambient light available in the area covered by the collection field of prism 302. Prism 302 can be shaped as desired to collect ambient light through a particular arc, either narrow, wide, or intermediate in width.

The output of photocell 308 is connected to processing circuit 310. Processing circuit 310 produces a control output compatible with the ballast 2 to control the brightness of the load 26 depending on the amount of light available from other sources. If prism 302 is situated to sense only light from source(s) other than load 26, processing circuit 310 may be constructed to reduce the brightness of load 26 depending on the amount of light available from the other source(s). Prism 302 may also be constructed and located so as to sense the total light in the area (from the load 26 and other sources). In particular, prism 302 may sense the total light reflecting from a critical work surface, such as a drafting table or desk, where a constant light level is desired. In such cases, processing circuit 310 may be a feedback control circuit which modifies the brightness of load 26 in response to changes in the amount of light sensed through photocell 308 to maintain a constant amount of light in the area, and thus a constant output of photocell 308. Such a feedback control circuit may incorporate proportional, integral, or derivative algorithms, or a combination of two or more of these algorithms or other algorithms commonly used in feedback control circuits. The output of processing circuit 310 is connected to the ballast 2 by control lines 316 which carry signals to effect control of the brightness functions of ballast 2.

Figure 4:
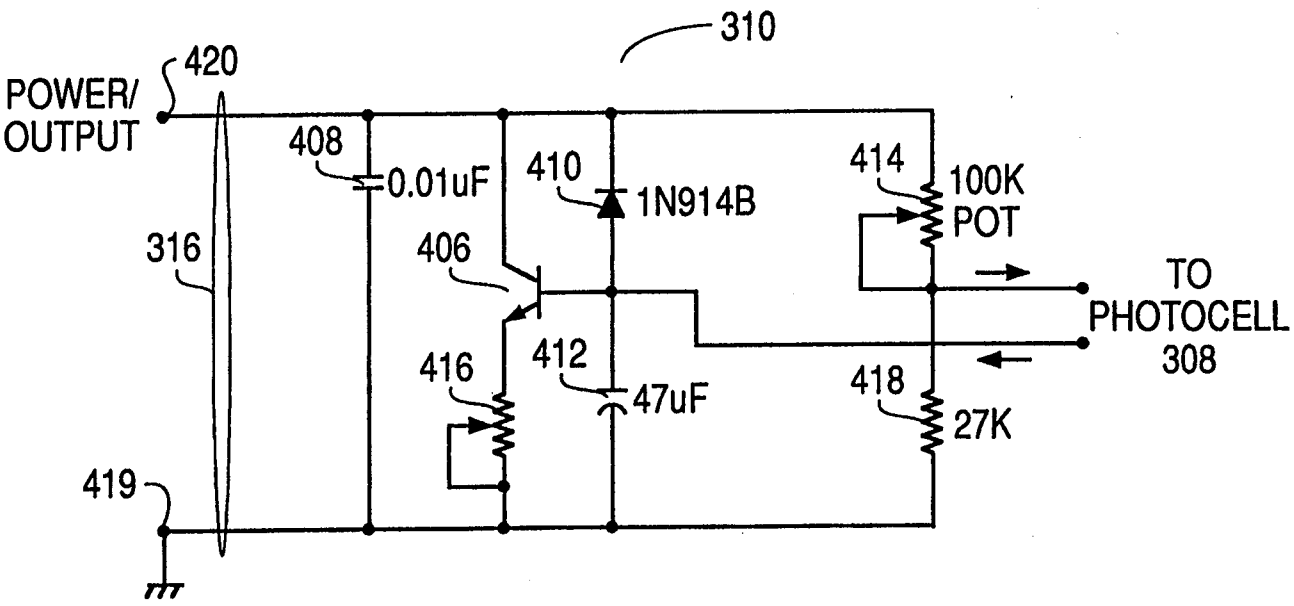
FIG. 4 is a schematic diagram of the ambient-light responsive electronic control circuit shown in FIG. 3.

FIG. 4 is a schematic circuit diagram showing a preferred embodiment of processing circuit 310. It is possible to construct a feedback control circuit in accordance with the discussion above to provide an amount of light in an area that is substantially constant, varying less than 1% from nominal. However, in most practical office applications, such precise control is not necessary. Human eyes are relatively insensitive to slight variations in light levels, and adjust readily to compensate for such variations. In addition, most work areas are not used for critical detail work. It has been found through experimentation that the total light in most work areas can deviate up to 10% from the baseline level without being objectionable. Therefore, to minimize cost, complexity, and maintenance, the preferred embodiment provides a relatively simple control circuit which dims a controlled lamp in response to an increase in externally provided light but does not measure total light directly to provide a closed-loop feedback control system.

In this embodiment, processing circuit 310 comprises transistor 406, capacitor 408, diode 410, capacitor 412, potentiometer 414, potentiometer 416, resistor 418, ground terminal 419, and output terminal 420. Transistor 406 is an NPN transistor of the N3904 type, and diode 410 is of the 1N914B type. Capacitor 408 is 0.01 uF; capacitor 412 is 47 uF; resistor 418 is 27 kiloOhms; and potentiometers 414 and 416 are 100 kiloOhm potentiometers. Output terminal 420 and ground terminal 419 of processing circuit 310 together make up the control lines 316, and are connected to the ballast 2 in a manner that will be described later in detail.

Photocell 308 is connected to the base of transistor 406. The collector of transistor 406 is connected to output terminal 420, and the emitter of transistor 406 is connected through potentiometer 416 to ground. Diode 410 is connected between the base of transistor 406 and output terminal 420. Capacitor 412 is connected between the base of transistor 406 and ground. Capacitor 408 is connected between output terminal 420 and ground. Photocell 308 has two terminals. One terminal of photocell 308 is connected to the base of transistor 406, and the other terminal of photocell 308 is connected through potentiometer 414 to output terminal 420 and through resistor 418 to ground. While power/output terminal 420 provides the operating voltage necessary to operate processing circuit 310, processing circuit 310 can also change the voltage at output terminal 420 if the voltage applied is sensitive to the resistance of processing circuit 310. Thus, power/output terminal 420 is both a source of power for, and an output of, processing circuit 310.

Depending on the intensity of the ambient light, photocell 308 changes its resistance, producing a higher resistance at low light levels and a lower resistance at higher light levels. Resistor 418 and potentiometer 414 together form a voltage divider, dividing the voltage applied through output terminal 420 so as to set the voltage applied to photocell 308. This voltage divider determines the base-to-emitter turn-on voltage of the transistor 406. The resistance of the photocell 308 to the applied voltage determines the current flowing into the base of transistor 406. When the base current of transistor 406 increases due to an increase in the ambient light level sensed by photocell 308, the collector-to-emitter current in transistor 406 is increased. The power/output terminal 420 will generally be connected to the middle of a voltage divider resistor network having a voltage source with limited current supplying capacity. As a result, when transistor 406 turns on, depending on the flow of current to the base of transistor 406, the output of the voltage source connected to power/output terminal 420 will begin to collapse. Thus, the magnitude of the voltage at power/output terminal 420 will be reduced.

Potentiometer 416 can be used to set a maximum dimming point, i.e. to adjust the amount of dimming produced by the processing circuit 310. Potentiometer 416 must be adjusted so that the maximum dimming level will not result in turn-off of the load 26. The choice of the capacitance of capacitor 412 and the resistance of photocell 308 determines the delay or response time for variation of the load brightness in response to variation in externally supplied light. Diode 410 operates to remove charge from the capacitor 412 within about 47 milliseconds after the power to ballast 2 is turned off, i.e. when Vref is removed. This operation resets the circuit 310 to provide full lamp brightness upon reactivation of ballast 2. Thus, diode 410 is a means for resetting the circuit to ensure that the fluorescent lamp is always started at full intensity to promote reliable starting and longer lamp life.

Power/output terminal 420 will be connected to the circuits of FIG. 1 and/or FIG. 2, depending on the desired configuration and the number of ballasts to be controlled by sensing and control circuit 300. It is a particular advantage of the present invention that a single low-voltage, low-power sensing and control circuit 300 can be used without substantial modification to control one electronic ballast 2, or a large number of electronic ballasts 2.

Referring to FIG. 1, if the ambient light sensing device of the present invention is to be used with a single ballast 2, and particularly when the ballast 2 does not have a dimming control circuit 42, power/output terminal 420 will be connected to non-inverting input 17 (pin 2 of pulse width modulator 4), and the ground terminal 419 will be connected to the ground of FIG. 1, i.e. to the grounded side of variable resistor 18 so that control lines 316 are connected across variable resistor 18. Thus, power/output terminal 420 is connected in the voltage divider comprising resistor 16 and variable resistor 18. The operation of processing circuit 310 as described above will reduce the voltage at non-inverting input 17 in response to an increase in externally-provided light sensed by photocell 308.

When ballast 2 is provided with an electronic dimming circuit 42 as detailed in FIG. 2, the power/output terminal 420 will be connected to the compensation pin (P1) of frequency source 65 and the ground terminal 419 will be connected to the ground of the circuit of FIG. 2, i.e. to the grounded side of variable resistor 94. Thus, control lines 316 of sensing and control circuit 300 are connected across variable resistor 94. With this connection, the power/output terminal 420 is connected to the center of the voltage divider comprising resistor 96 and variable resistor 94. As noted previously, the compensation pin (P1) of frequency source 65 controls the duty cycle of the pulse width modulated output of electronic dimming circuit 42 which controls the brightness of the load 26. Thus, when transistor 406 is turned on by ambient light impinging on photocell 308, the voltage on the compensation pin will be reduced and the pulse output of electronic dimming circuit 42 will have a reduced duty cycle. In this way, the circuit of the present invention produces further dimming of the load 26 in response to an increase in ambient light. It is a particular advantage of this embodiment that the dimming produced in response to any increase in ambient light occurs with reference to the dimming level set by the occupant of the area using variable resistor 94. Thus, any desired light level can be produced, and the selected level will be approximately maintained in spite of fluctuations in externally available light such as sunlight.

A particular advantage of sensing and control circuit 300 of the present invention is that this circuit can be used readily with one or many lighting fixtures. In addition, sensing and control circuit 300 is useful both with fixtures driven only by electronic ballasts 2, and also with fixtures which further incorporate a low-voltage, pulse-width modulated brightness control circuit such as electronic dimming circuit 42.

Electronic dimming circuit 42 can be used to control a plurality of ballasts 2; therefore, if desired, a single sensing and control circuit 300 may be connected to an electronic dimming circuit 42 to control a plurality of ballasts 2 to dim their loads 26 in response to an increase in ambient light. Alternatively, the control lines 316 could be connected in parallel to a plurality of electronic dimming circuits 42 (across variable resistor 94 in each as described previously). If a large number of electronic dimming circuits 42 and/or ballasts 2 are to be connected to a single sensing and control circuit 300, sensing and control circuit 300 should be provided with amplifying means, such as a transistor circuit, to increase its fanout capacity. For example, an NPN power transistor can be used to increase the fanout capability of sensing and control circuit 300 by connecting its base to the output, its collector to a DC power source such as that provided at Vcc (pin 7) of frequency source 65, and connecting its emitter to the electronic dimming circuits 42 and/or ballasts 2 to be controlled thereby. Various techniques of increasing fanout capacity of the output are within the ability of those of ordinary skill in the art, and will not be described further here. Thus, it can be seen that the fanout capability can be expanded to allow control of almost any number of ballasts 2 and/or electronic dimming circuits 42 using well-known techniques.

The design of the present invention therefore permits a single sensing and control circuit 300 to be connected directly to the non-inverting inputs 17 of a plurality of ballasts 2, or the terminals P1 of a plurality of electronic dimming circuits 42, to control a large number of lamps. The use of a single sensing and control circuit 300 as described herein is particularly desirable since this method reduces cost and enhances reliability. In addition, a single sensing and control circuit 300 will provide more uniform control of lights in a given area such as in a single room. Because of ambient light variation within areas, and because of variations in calibration and response between multiple sensing and control circuits 300, lamps in the same area that are controlled by different sensing and control circuits 300 may exhibit variation in light output. This continual variation may be annoying to persons working in the area. Thus, it is preferable to use a single sensing and control circuit 300 to control all the lamps in a lighting zone.

Sensing and control circuit 300 is a low-voltage, low-power circuit and connects only to the low-voltage, low power side of the integrated circuits used in ballast 2 and electronic dimming circuit 42. Thus, wires connecting sensing and control circuit 300 to the various electronic dimming circuits 42 and/or ballasts 2 controlled by the sensing and control circuit 300 need not conform in size or routing to the code requirements that would be applicable to wires needed to operate higher power and voltage circuits.

Figure 5:
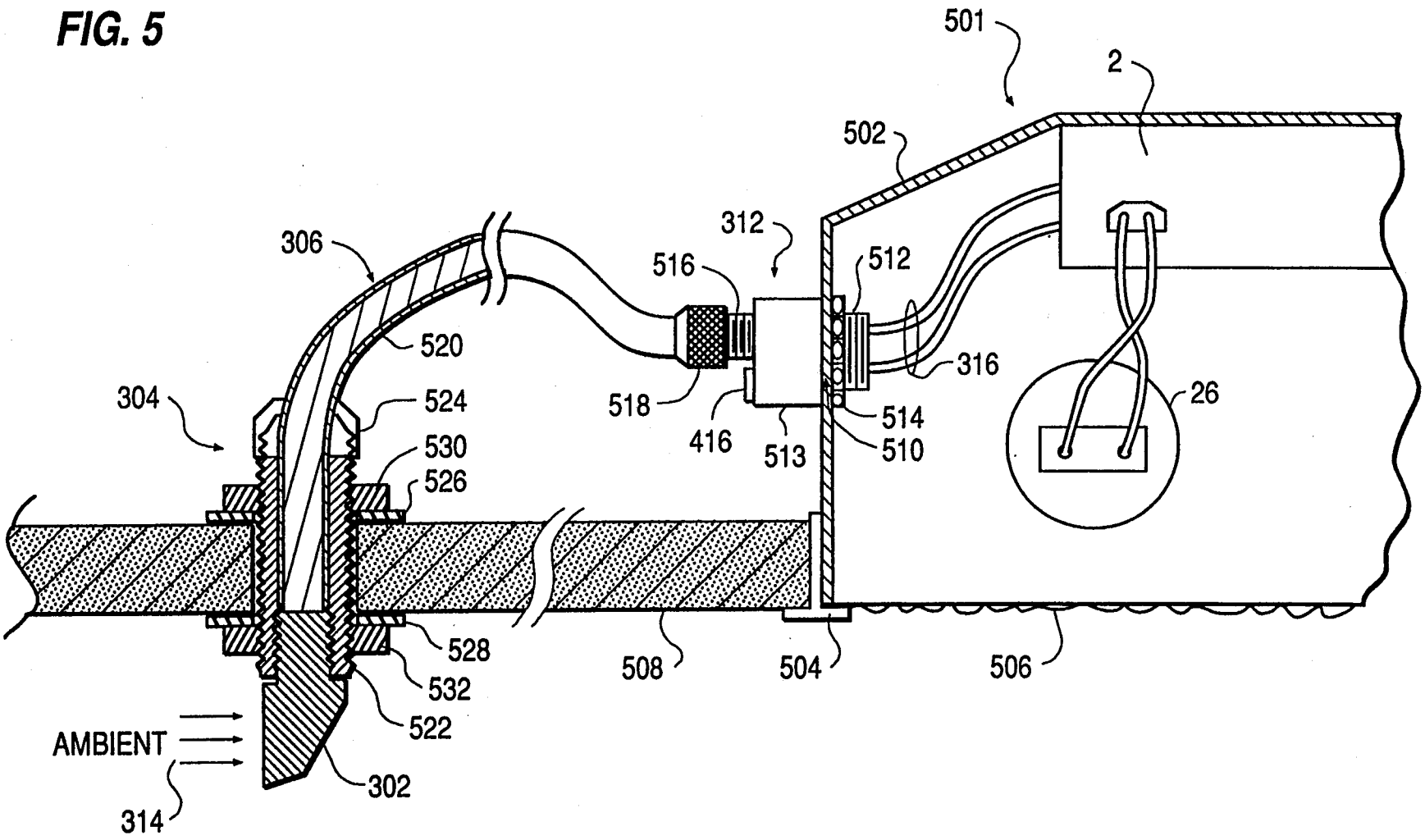
FIG. 5 is a diagram showing installation of the system of the present invention in conjunction with a fluorescent ceiling fixture.

FIG. 5 details a preferred arrangement and construction of the components shown in FIG. 3. This arrangement is particularly designed for use with fluorescent lights installed in a typical office building "grid and panel" ceiling system. As shown, a fixture 501 comprises the load (fluorescent tube) 26 and dimming ballast 2, located in fixture housing 502. Fixture 501 is suspended in ceiling grid 504. A translucent diffuser 506 covers the components in fixture housing 502. Ceiling panels 508 fill the sections in ceiling grid 504 which do not contain a fixture housing 502. Ballast 2 is connected to and drives load 26. Fixture 501 will generally contain three or four similarly connected loads 26, although for clarity only one load 26 is shown in FIG. 5.

Fixture housing 502 is conventional in that it has one or more holes 510 with removable knockout plugs. Such holes are generally provided in fixtures to accept cable clamps and thus facilitate electrical power service to fixture 501.

Housing 312 is preferably a small, round plastic housing with a body 513 and a threaded portion 512 smaller than the body 513. Threaded portion 512 is installed through hole 510 of fixture housing 502. Housing 312 is held in place by a locking nut 514 of the type normally used with electrical cable clamps. From the end of housing 312 opposite threaded portion 512, an adjustment for potentiometer 416 projects so that this adjustment is accessible without removing or disturbing housing 312. Potentiometer 416 may be of the type which is adjustable using a screwdriver, and will then be installed so that the adjustment is accessible from outside housing 312. Also, fiber optic cable receptor 516 is provided on housing 312. Receptor 516 is a hollow tube of brass or other appropriate material, threaded on the outside, and having four slots cut in its end, transverse to the threads, at 90 degree intervals about its circumference. The very end of receptor 516 has an unthreaded portion which is beveled on the outside surface so that the beveled surface forms a portion of a cone with its apex beyond the beveled end of receptor 516. The hollow portion of receptor 516 receives the end of fiber optic cable 306, which slides in and is held in close proximity to photocell 308, which is located in housing 312 (as shown in FIG. 3). The threads on receptor 516 receive brass locking nut 518, which, through tightening onto the beveled end of receptor 516, slightly compresses receptor 516 toward its central longitudinal axis, thus tightening the slotted portions thereof against fiber optic cable 306. Thus, receptor 516 is a means for lockably connecting fiber optic cable 306 to the housing 312 in a fixed manner so that light passing through fiber optic cable 306 shines on photocell 308.

Fiber optic cable 306 is preferably a stranded fiber optic cable with a plastic insulating jacket 520. Fiber optic cable 306 preferably has a total diameter on the order of 0.125 inches, and will be sized in conjunction with receptor 516, locking nut 518, and the components of housing 304 to permit good mechanical and light transmission connections therebetween.

Housing 304 comprises threaded tube 522, locking nut 524, flat washers 526 and 528, and nuts 530 and 532. Threaded tube 522 may be a brass tube, generally similar to the previously described receptor 516. The tube 522 is hollow throughout, and is threaded on the entire outside surface and on at least part of the inside surface to receive prism 302. The end of tube 522 proximate to the fiber optic cable 306 is slotted and beveled as previously described with reference to the fiber optic cable end of receptor 516. Locking nut 524 is identical to locking nut 518 and, like locking nut 518, serves as a means to hold fiber optic cable 306 stationary relative to the associated fiber optic receiving tube. Of course, other types of compression fittings, such as plumbing fittings, and various other types of clamping hardware designs could also be used within the spirit of the invention.

Tube 522 is preferably 1.75 inches long, although other lengths could be used. What is important is that tube 522 be of sufficient length to pass through the thickness of ceiling panel 508 or other structural member through which installation is desired, leaving sufficient space on the ends of tube 522 for connection of the necessary fittings. Specifically, washers 526 and 528 and nuts 530 and 532 are tightened on the outside threads of tube 522 to hold housing 304 in place with respect to ceiling panel 508. Washers 526 and 528 are preferably large plastic washers formed in a color to match and thus visually blend into the ceiling panels 508.

Prism 302 is threaded into one end of the tube 522, and fiber optic cable 306 is inserted into the other end of tube 522 and clamped, using locking nut 524, in light transferring relationship with prism 302, e.g. so that the end of fiber optic cable 306 abuts prism 302. Fiber optic cable 306 is preferably of sufficient length to permit desired positioning of housing 304 relative to the source of ambient light 314, while not generating excessive cost or producing so much light loss due to its length that operation of the circuit is adversely affected. In practice, a length of about 22 inches has been found effective.

Figure 6A:
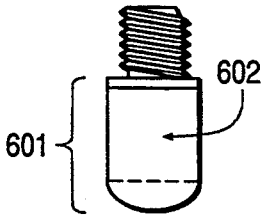
Figure 6B:
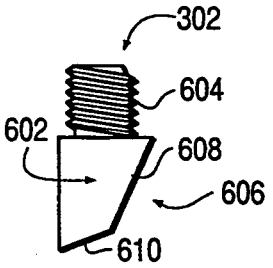
FIG. 6*b* is a corresponding side view of the same prism.

FIGS. 6*a* and 6*b* show the construction of prism 302 in greater detail. Prism 302 has a body 601 in the shape of a partially cut-out cylinder. The non-cut-out portion of body 601 defines a collecting surface 602, and the cut-out portion defines a beveled reflecting portion 606. FIG. 6*a* is a frontal view of prism 302 particularly showing the collecting surface 602 of prism 302. FIG. 6*b* is a corresponding side view of the same prism, showing the shaping of the beveled, reflecting portion 606. To facilitate light collection, beveled portion 606 has two substantially flat reflecting surfaces 608 and 610 which tend to reflect light approaching from different angles upward through threaded portion 604. Preferably, the angle between collecting surface 602 and reflecting surface 608 is about 30 degrees, and the angle between collecting surface 602 and reflecting surface 610 is about 60 degrees. When prism 302 is installed very close to a ceiling, the reflecting surfaces 608 and 610 will be especially effective at gathering light reflected from the ceiling itself and also at gathering light coming directly through a window. This precise light gathering capability makes possible the use of the less complex circuits and simple algorithms of the preferred embodiment. Prism 302 is preferably made from clear Lucite or other appropriate formable, translucent optical material.

Positioning of the reflecting prism 302 is important to assure maximum energy savings and proper performance of the circuit. In general, the prism should be positioned with the collecting surface 602 facing the window or other ambient light source. The top of the unthreaded part of prism 302 should be installed as nearly flush with the lower surface of ceiling panel 508 as possible.

Prism 302 could also be installed to collect light from a region below the housing 304, such as from a work surface. However, such an arrangement is less preferred because movement in the area and variations in the reflectivity of surfaces will significantly affect the amount of light collected by the simple prism 302, causing undesired lighting effects. A more complex lens, capable of gathering light from a wide area so as to average the light readings from the area, is required for downward monitoring to avoid abrupt shifts in load brightness due to movement in the area or placement of papers on a desk. A system using downward light collection will generally produce more accurate control of load brightness, but significantly increases the cost and complexity of the system. Thus, the system design shown in FIG. 5 is preferred over a downward-aimed light collection system because it provides acceptable operation with minimum cost and complexity.

I claim:

1. A lighting control device for use with an area lighting fixture including a lamp and a, dimming circuit for reducing brightness of the lamp depending on the amount of sunlight present to maintain a desired amount of light in an area lit by the area lighting fixture, comprising:

collecting means for collecting ambient light representing a lighting level in said area including sunlight;

flexible cable means having first and second ends, the first end connected to the collecting means in light transmission relationship for receiving and carrying the sunlight collected by the collecting means;

photocell circuit means connected to the second end of the flexible cable means and adapted to be connected to the dimming circuit, for receiving said sunlight from the flexible cable, generating a variable dimming control signal varying with the amount of sunlight available to the area, and transmitting said dimming control signal to said lighting fixture dimming circuit to effect reduction of said lamp brightness in response to an increase in available sunlight.

2. The device of claim 1, wherein said collecting means is adapted for installation in a ceiling proximate to the lighting fixture.

3. The device of claim 2 wherein said collecting means includes locking means for fixing the collecting means in an installation hole formed in a grid-type ceiling panel.

4. The device of claim 3, wherein said collecting means is adapted to collect light primarily from one direction.

5. The device of claim 4 wherein the collecting means comprises a prismatic lens having a directional receiving surface and at least one reflective surface for reflecting ambient light received through the receiving surface into the first end of the flexible cable means.

6. The device of claim 5 wherein the prismatic lens has at least two reflective surfaces, one at about a 30 degree angle with respect to the receiving surface and the other at about a 60 degree angle with respect to the receiving surface.

7. The device of claim 3, wherein the collecting means comprises a threaded tube with two ends which receives an ambient light-collecting lens at one end of the tube, with the first end of the flexible cable means inserted into the other end of the tube.

8. The device of claim 7 wherein said locking means include nuts threaded onto the outside of said tube to hold the tube in a hole provided therefor.

9. The device of claim 7 wherein the ambient light-collecting lens is threaded for installation into the one end of the tube.

10. The device of claim 7 further including cable locking means for holding the flexible cable means in a fixed position relative to the tube.

11. The device of claim 10 wherein the one end of the tube is compressible and said cable locking means comprises a compression nut for compressing the one end of the tube onto the flexible cable means.

12. The device of claim 2 wherein said photocell circuit means is contained in a housing adapted for connection to the lighting fixture through a standard knockout plug.

13. The device of claim 12 wherein said housing comprises a housing tube for receiving the second end of the flexible cable means and holding said second end in light transmission relationship with the photocell circuit means.

14. The device of claim 13 further including cable locking means for holding the flexible cable means in a fixed position relative to the housing tube.

15. The device of claim 14 wherein one end of the housing tube is compressible and said cable locking means comprises a compression nut for compressing the one end of the tube onto the flexible cable means.

16. The device of claim 12 wherein said photocell circuit means includes a sensitivity adjustment adjustable from the housing exterior.

17. The device of claim 1 wherein said photocell circuit means further includes delay means for preventing the photocell-circuit means from affecting the lamp brightness during a defined period immediately after activation of the lamp so that the lamp is started at full brightness.

18. The lighting control device of claim 1, further comprising a control circuit connected to said lighting fixture dimming circuit for generating a low-power, variable DC control input voltage which is applied to a control input of a power circuit to control the brightness of the lamp, said control circuit comprising control pulse generating means for generating control pulses of variable duty cycle; brightness control means connected to the control pulse generating means for setting the desired brightness of the lamp; and integrating means, connected between the power circuit control input and the control pulse generating means, for integrating the variable-width control pulses of the control pulse generating means to produce said variable DC control input voltage to the control input of the power circuit.

19. The lighting control device of claim 18 wherein said photocell circuit means is connected to said control circuit so that said variable dimming control signal produced by said photocell circuit means is integrated along with said variable duty cycle control pulses to generate said variable DC control input voltage.

20. The lighting control device of claim 19 wherein the control output of a single said photocell circuit means is connected to a plurality of said control circuits.

21. The lighting control device of claim 18 wherein the brightness control means and the photocell circuit means are both connected to a common input terminal of the control pulse generating means such that the brightness control means and the photocell circuit means simultaneously affect the brightness of the lamp load.

22. The lighting control device of claim 18 wherein said control pulse generating means comprises a single integrated circuit pulse width modulator.

23. The lighting control device of claim 22 wherein said photocell circuit means is connected to said control circuit so that said variable dimming control signal produced by said photocell circuit means is integrated along with said variable duty cycle control pulses to generate said variable DC control input voltage.

24. The device of claim 1 wherein said photocell circuit means further comprises light equalizing means for reducing the brightness of the lighting fixture as ambient light from said other source increases and for increasing the brightness of the lighting fixture as ambient light from said other source decreases, to compensate for variations in light available from said other source and maintain a perceptively constant total light level in the area.

25. A method of saving energy used by a lighting fixture including a lamp and an associated dimming circuit for variably controlling brightness of the lamp to provide a desired amount of light to an area, comprising the steps of:

providing an apparatus comprising collecting means for collecting ambient light representing a lighting level in the area including sunlight flexible cable means having first and second ends, the first end connected to the collecting means in light transmission relationship for receiving and carrying sunlight collected by the collecting means; and photocell circuit means connected to the second end of the flexible cable means and adapted to be connected to the dimming circuit, for receiving said ambient light from the flexible cable, generating a variable dimming control signal varying with the amount of sunlight, and transmitting said dimming control signal to said lighting fixture dimming circuit to effect reduction of said lamp brightness in response to an increase in available ambient light from the source other than the lighting fixture;

positioning the collecting means to collect at least sunlight;

operating the apparatus to reduce the brightness of the lighting fixture as available sunlight increases and to increase the brightness of the lighting fixture as available sunlight decreases, to compensate for variations in available sunlight and maintain a perceptively constant total light level in the area, whereby total energy consumption of the lighting fixture is reduced.

* * * * *